US010612374B2

(12) United States Patent
Kleinguetl et al.

(10) Patent No.: US 10,612,374 B2
(45) Date of Patent: Apr. 7, 2020

(54) APPARATUS AND METHODS TO MANAGE WELLBORE FLUID PROPERTIES

(71) Applicant: Halliburton Energy Services, Inc., Houston, TX (US)

(72) Inventors: Kevin Gregory Kleinguetl, Kingwood, TX (US); Dale E. Jamison, Humble, TX (US); Jason Glen Bell, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 15 days.

(21) Appl. No.: 15/568,879

(22) PCT Filed: Jun. 10, 2015

(86) PCT No.: PCT/US2015/035074

§ 371 (c)(1),
(2) Date: Oct. 24, 2017

(87) PCT Pub. No.: WO2016/200379

PCT Pub. Date: Dec. 15, 2016

(65) Prior Publication Data

US 2018/0100392 A1 Apr. 12, 2018

(51) Int. Cl.
*E21B 49/08* (2006.01)
*E21B 44/00* (2006.01)

(52) U.S. Cl.
CPC ..... *E21B 49/088* (2013.01); *E21B 44/00* (2013.01); *E21B 49/08* (2013.01); *E21B 2049/085* (2013.01)

(58) Field of Classification Search
CPC ..... E21B 49/08; E21B 49/088; E21B 44/00; E21B 2049/085; E21B 21/06
See application file for complete search history.

(56) References Cited

U.S. PATENT DOCUMENTS

| | | | | |
|---|---|---|---|---|
| 4,300,724 | A | 11/1981 | Reynolds | |
| 4,347,002 | A | 8/1982 | Born | |
| 4,501,143 | A | 2/1985 | Prior et al. | |
| 5,896,883 | A | 4/1999 | Khalatbari et al. | |
| 6,517,733 | B1 | 2/2003 | Carlson | |
| 8,117,016 | B2 * | 2/2012 | Halabe | E21B 49/00 703/6 |
| 8,805,617 | B2 | 8/2014 | Zuo et al. | |

(Continued)

FOREIGN PATENT DOCUMENTS

| | | |
|---|---|---|
| CA | 2923012 A1 | 4/2015 |
| WO | 2012125934 | 9/2012 |

OTHER PUBLICATIONS

International Search Report and Written Opinion of PCT Application No. PCT/US2015/035074 dated Nov. 6, 2015: pp. 1-14.

(Continued)

*Primary Examiner* — Yong-Suk Ro
(74) *Attorney, Agent, or Firm* — Chamberlain Hrdlicka

(57) ABSTRACT

A corrective product addition treatment or surface treatment to a wellbore fluid is based on performing an artificial intelligence technique and/or a closed form solution with respect to one or more fluid properties. Pilot testing and operational testing to operatively dose a fluid at a drilling site may be integrated into the corrective product addition treatment or surface treatment to a wellbore fluid.

21 Claims, 6 Drawing Sheets

(56) References Cited

U.S. PATENT DOCUMENTS

| | | | | |
|---|---|---|---|---|
| 9,696,193 | B2 * | 7/2017 | Martin | E21B 47/10 |
| 2008/0156486 | A1 * | 7/2008 | Ciglenec | E21B 49/10 166/250.15 |
| 2010/0059226 | A1 | 3/2010 | Termine et al. | |
| 2011/0040501 | A1 | 2/2011 | Martin et al. | |
| 2011/0299357 | A1 | 12/2011 | Vasshus et al. | |
| 2012/0285231 | A1 | 11/2012 | Rickman | |
| 2013/0032339 | A1 | 2/2013 | Kalia et al. | |
| 2013/0318019 | A1 | 11/2013 | Jamison et al. | |
| 2014/0326449 | A1 * | 11/2014 | Samuel | E21B 44/00 166/250.01 |
| 2016/0216187 | A1 * | 7/2016 | Gao | E21B 49/08 |
| 2018/0114158 | A1 * | 4/2018 | Foubert | E21B 41/00 |
| 2018/0238164 | A1 * | 8/2018 | Jamison | G05B 13/027 |

OTHER PUBLICATIONS

Anonymous, "Drilling Fluids—Mud Testing Kits: Pilot Test Kit," OFI Testing Equipment, Inc., 2015: p. 1, <www.ofite.com>.

Pal, "Single-Parameter and Two-Parameter Rheological Equations of State for Nondilute Emulsions," Ind. Eng. Chem. Res., vol. 40 (23), 2001: pp. 5666-5674.

Razi et al., "Artificial Neural Network Modeling of Plastic Viscosity, Yield Point, and Apparent Viscosity for Water-Based Drilling Fluids," Journal of Dispersion Science and Technology, vol. 34, 2013: pp. 822-827.

Zamora et al., AADE-14-FTCE-31: "High-Fidelity Training Simulators Enhance Drilling Fluid Skills and Competencies," AADE American Association of Drilling Engineers, 2014: pp. 1-7.

Yongbin et al., "Performance-Oriented Drilling Fluids Design System With a Neural Network Approach," IEEE Computer Society, 2009 Fourth International Conference on Computer Sciences and Convergence Information Technology, 2009: pp. 1280-1283.

* cited by examiner

APPARATUS AND METHODS TO MANAGE WELLBORE FLUID PROPERTIES

TECHNICAL FIELD

The present invention relates generally to apparatus and methods of measurement related to oil and gas exploration.

BACKGROUND

In drilling wells for oil and gas exploration, there is commonly a reliance on experience or computer models to make simple fluid formulation changes to manage fluid properties and their impact on operations. Some difficulties rise using models, since knowledge of exactly what is in a fluid may be missing. Often, models will not properly anticipate the impact of product additions. In some cases field engineers may do pilot tests, however their capacity is limited to a very few tests. A pilot test is a test or series of tests to predict behavior of an entity, such as but not limited to drilling fluid, and to guide future actions to be taken with respect to the entity. Drilling fluids are often referred to as drilling mud or mud. Pilot tests allow for an evaluation of the effects on an entity from a simulation or addition to the entity. Typically, a pilot test is directed to a sample volume instead of the complete volume of the entity.

The usefulness of such measurements may be related to the precision or quality of the information derived from such measurements. On-going efforts are being directed to improving techniques to enhance the precision or the quality of the information derived from such measurements and to control operations based on the enhanced data.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, and electrical changes may be made to these embodiments. The various embodiments are not necessarily mutually exclusive, as some embodiments can be combined with one or more other embodiments to form new embodiments. The following detailed description is, therefore, not to be taken in a limiting sense.

In various embodiments, artificial intelligence (AI) techniques, such as, but not limited to artificial neural networks (ANN), cognitive computing, statistical methods, probability methods, mathematical optimization, expert systems, data mining, and machine learning, can be coupled with one or more physical models to predict various physical properties of wellbore fluids and their performance relative to various constraints. The physical models may be empirical or physics based models. In an example, the rheology of drilling fluids can be managed based on changes in concentration of its components/additives to maintain target or planned values in a real time environment. Maintaining target or planned values in a real time environment can include maintaining such target or planned values associated with an oil/gas well as the oil/gas well is being drilled.

A closed form solution may be used to determine and/or predict a fluid's viscosity change due to the rheological contribution of each additive injected to the fluid. A closed form solution is a mechanism to provide a determination of a parameter directly from a set of measurements of variable properties, which are related to the parameter, and empirical factors associated with the parameter and variable properties. Artificial intelligence techniques can combine with these in an additive way to model how the various chemical and physical interactions between the additives contribute to the rheological properties. For example, the total rheological response of product addition or removal may be determined.

Figure 1:
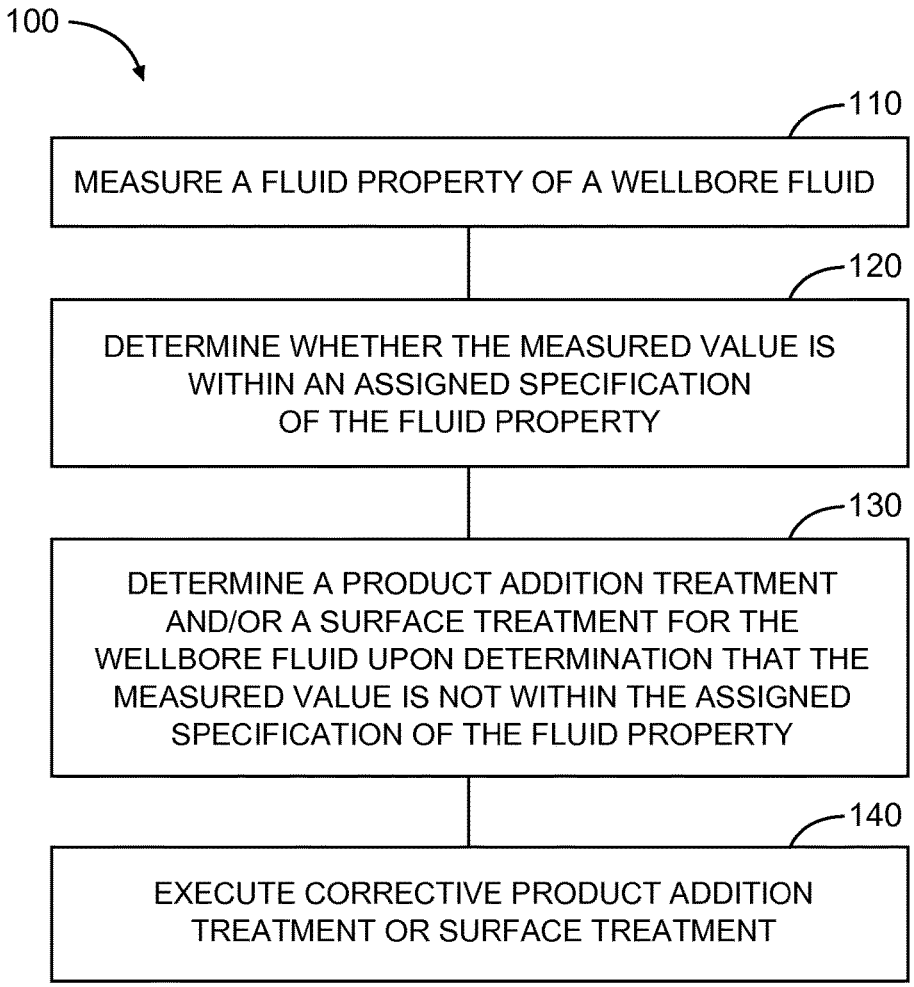
FIG. 1 is a flow diagram of an example method of executing corrective action to a wellbore fluid at a drilling site, in accordance with various embodiments.

FIG. 1 is a flow diagram of an embodiment of an example method 100 of executing corrective action to a wellbore fluid at a drilling site. At 110, a fluid property of a wellbore fluid is measured. The wellbore fluid may be a drilling fluid. At 120, a determination is made as to whether the measured value is within an assigned specification of the fluid property. A fluid may be considered in condition for operation at the drilling site when the fluid property or a set of fluid properties are within a respective range of values, which can be assigned as parameters for a drilling operation. At 130, a product addition treatment and/or a surface treatment for the wellbore fluid are determined. This determination can be conducted by performing an artificial intelligence technique and/or a closed form solution upon determination that the measured value is not within the assigned specification of the fluid property. The AI technique may be realized as ANN, an AI technique other than ANN, or combinations of AI techniques. At 140, corrective product addition treatment or surface treatment is executed based on performing the artificial intelligence technique and/or the closed form solution, such as a model or numerical solution. The execution may be performed by generating a plan for the corrective product addition treatment or surface treatment. The execution may be performed by generating control signals to equipment to perform the corrective product addition treatment or surface treatment.

The corrective product addition treatment and/or surface treatment can be executed to place the fluid property within the assigned specification of the fluid property. One or more corrective product addition treatments and/or surface treatments can be executed to place a set of fluid properties within their respective assigned specifications. Determining the product addition treatment or surface treatment for the wellbore fluid can include determining whether the fluid property with the product addition treatment and/or surface treatment meets an operational criterion in addition to the assigned specification of the wellbore fluid. The operational criterion can include one or more of hydraulics constraints, such as; fracture gradient, pore pressure, ECD (equivalent circulation density), flow rate, pipe rotation speeds, pipe running speeds, and others such as; torque and drag, filtration control, or lost circulation material background targets. Utilization of one or more operational criteria in addition to adherence of the assigned specification may be applied to a set of fluid properties.

Methods similar to or identical to method 100 may include determining a new product addition treatment and/or a new surface treatment for the wellbore fluid by performing a second AI technique and/or a second closed form solution upon determination that the current product addition treatment and/or the current surface treatment is not executable in time to meet expected upcoming formation issues ahead of an operating drill bit. The second AI technique may be the same as the artificial intelligence technique used to evaluate the previous product addition treatment and/or surface treatment or it may be conducted using one or more other AI techniques. The second closed form solution may be the same as the closed form solution used to evaluate the previous product addition treatment and/or surface treatment or it may be conducted using one or more other closed form solutions.

Methods similar to or identical to method 100 may include updating a database with data for the executed corrective product addition treatment or surface treatment as a function of a drilling parameter. A plan can be updated with data for the executed corrective product addition treatment or surface treatment as a function of many drilling parameters. The drilling parameters may include, but not limited to measured depth, true vertical depth, wellbore geometry and components, hole angle and azimuth, flow rate, drill pipe rpm, flow rate, ECD, rate of penetration (ROP), bottom hole assembly (BHA) vibration, cuttings size, lithology, surface treatment equipment such as shakers, degassers, other constrains, or combinations thereof.

In oil based fluids, the impact on rheology of emulsions may be modeled for various combinations of oil and water with the varying viscosities of each component. In addition, salinity impact on the viscosity of the water may be included. Potential ways to model the emulsions were suggested in Pal, R., "Single-Parameter and Two-Parameter Rheological Equations of State for Non dilute Emulsions," *Ind. Eng. Chem. Res.*, 2001 40(23), 5666-5674. Inclusion of nonreactive solids, such as weighting and lost circulation materials, and their impact on a fluid viscosity can be modeled using a model such as the viscosity models in Table 1.

TABLE 1

| Model | Equation | Use and/or Range |
|---|---|---|
| Einstein | $U^* = 1 + 2.5\phi$ | $\phi \leq 0.02$ |
| Gurh Gold Simha | $U^* = 1 + 2.5\phi + 14.1\phi^2$ | $\phi \leq 0.06$ |
| Richardson | $U^* = \exp^{a\phi}$ | Emulsions |
| Oliver Ward | $U^* = 1 + a\phi + (a\phi)^2 + (a\phi)^3$ | Dispersion of spheres |
| Simha | $U^* = 1 + \frac{32\phi}{15\pi p}$ | Anisometric particle suspensions p = minor axis/major axis |
| Thomas | $U^* = 1 + 2.5\phi + A\phi^2 + B\exp^{C\phi}$ | Suspensions |

In Table 1, the various variables and reference symbols are defined as follows:

$$U^* = \frac{U_f}{U_0},$$

where $U_f$=final viscosity; $U_0$=initial viscosity; $\phi$=solids volume fraction (range=0 to 1); and the group (A, B, C, and $\alpha$) are empirical constants. These equations are examples of a closed form solution or model with respect to viscosity. Use of closed form solutions is not limited to viscosity. Closed form solutions for other fluid properties may be used such as, for example, fluid density, fluid loss, wellbore strengthening material selection, fluid density with temperature and pressure, gel strength at temperature and pressure, and rheology at temperature and pressure. Rheology relates to the science of deformation and flow of matter, while viscosity relates to resistance of a fluid to flow. For Newtonian fluids, the flow resistance is constant and independent of shear rate. For non-Newtonian fluids, the resistance to flow can be characterized by its apparent viscosity, which is shear rate dependent. In some applications, input parameters of one closed form solution may have dependence on other closed form solutions to provide the required data to determine some fluid properties.

The impact of various conditions and additives may then be reduced to a single input parameter into the selected artificial intelligence technique to simplify the inputs required for the ANN system to predict the desired fluid property. The single input parameter may include, but not be limited to, initial rheology, initial viscosity, gel strength, suspend ability for lost circulation materials (LCMs), sag resistance, fluid loss, fracture tip plug ability, LCM product resiliency or modulus, filter-cake permeability, and others. This reduction in dimensionality can help conduct the artificial intelligence technique in terms of speed and accuracy.

The training group data of the artificial intelligence technique such as an artificial neural network can be modified using one or more of the closed form models. The artificial intelligence technique may use an artificial neural network. The AI technique can then be trained using this modified data and the interactions between the various additives can be identified. When trying to predict the viscosity or the rheology of a new formulation, the opposite can be performed. Nonreactive solids can be reduced down to a single parameter and with this parameter and other inputs, a viscosity or rheology can be calculated using the AI technique. This viscosity or rheology can then be modified using one or more of closed form models. For example, the Thomas equation can be utilized to determine the actual fluid viscosity.

Figure 2:
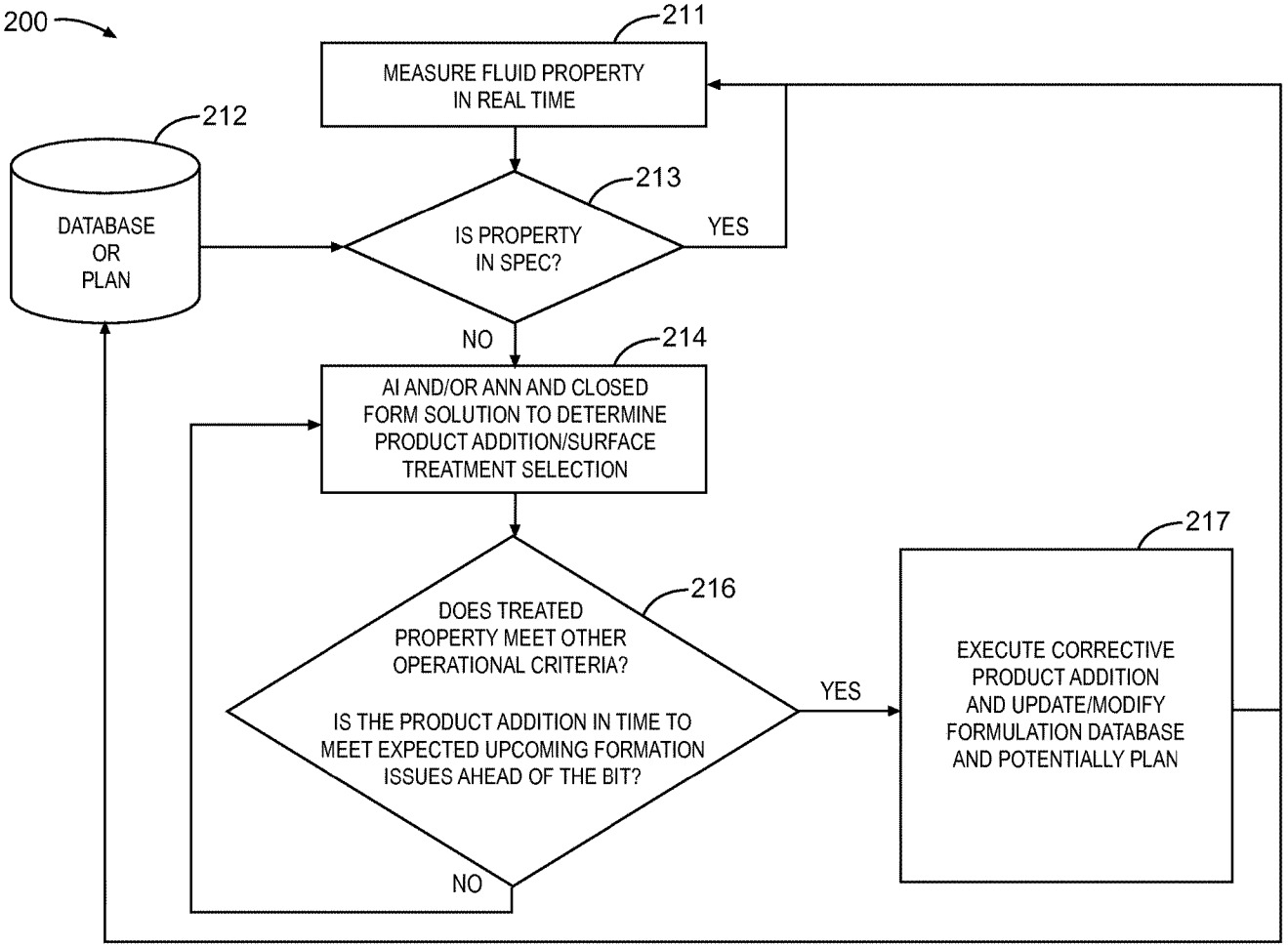
FIG. 2 is a flow diagram of an example process for real time application of an artificial intelligence technique and a closed form solution, in accordance with various embodiments.

FIG. 2 is a flow diagram of an embodiment of an example process 200 for real time application of an AI technique and/or a closed form solution. The AI technique may be realized as ANN, one or more AI techniques other than ANN, or a combination thereof. A database or plan with respect to hole depth or other constraint can determine the specifications of a property of the drilling fluid, at 212. If the property is within the specifications, determined at 213, the property can be monitored in real time as a drilling operation occurs. The monitoring may be maintained without other actions taken till it no longer is within the specifications. The monitoring can be conducted using conventional techniques for the selected fluid property. The conventional techniques may be implemented to measure the selected fluid property and/or other selected fluid properties in real time, at 211. When the property is no longer within the specifications, AI, ANN, a closed form solution, or combinations thereof can be used to determine what product addition and/or surface treatment can be used to adjust the property back to within the specifications, at 214. For example, treatments may include, but are not limited to, centrifuging, screening, and product additions such as: viscosifiers, thinners, weighting materials, lubricants, lost circulation materials, base fluid dilution.

At 216, the treated property can be subjected to one or more other operational criteria and/or evaluated as to whether the treated property is available for operation to meet expected upcoming formation issues ahead of the drill bit. If the treated property does not meet other operational criteria such as hydraulic constraints, torque and drag, filtration control, LCM background targets, etc., a new treatment can be determined using similar methods as were used to generate the previous treatment, at 214. Also, if the product addition is not in time in an operation to meet expected upcoming formation issues ahead of the drill bit, a new treatment can be determined, at 214. This process can be repeated until an eligible treatment is determined. Once the appropriate treatment has been determined, it can be executed, at 217, and the database and/or plan can be updated at 212 from 217. A plan may include such procedures as maintaining rheology at a certain level for different sections of a well. Execution of corrective product addition and update/modify a formulation database and potential plan may include rate based addition constraints in various automation schemes. For example, the amount of a component to add at the hopper may be rate limited to the pump rate to avoid excessive viscosity, insufficient viscosity, settling, screen blinding, fish eyeing, or other operational issues. The fluid can then be monitored, for example without further action being taken, till the property is no longer in specifications.

In various embodiments, apparatus and techniques, as taught herein, can combine both a closed form solution and artificial intelligence to calculate a more accurate model. For example, consider a drilling operation in which a loss circulation zone is expected, an evaluation may result in a determination to add LCMs to the drilling operation, but it is desired to know if the rheology including the addition will be manageable based on what the formation can take with pressure. A closed form solution may be implemented to indicate where the drilling operation is likely to be. If the closed form solution indicates that the drilling fluid is out of specification, for example too high, a neural net solution can be used to determine the amount of treatment should be conducted to place the drilling fluid back to its right place within its specification. The combination of both the closed form solution and artificial intelligence can lead to a more accurate model than either alone. This approach can cut down on the required experiments to create a data set for a neural network, because the non-reactive solids and emulsions can be ignored. This in turn can save time and expense.

In various embodiments, a non-transitory machine-readable storage device can comprise instructions stored thereon, which, when performed by a machine, cause the machine to perform operations, the operations comprising one or more features similar to or identical to features of methods and techniques described herein. The physical structures of such instructions may be operated on by one or more processors. Executing these physical structures can cause the machine to perform operations comprising: measuring a fluid property of a wellbore fluid such that a measured value of the fluid property is provided; determining whether the measured value is within an assigned specification of the fluid property; determining a product addition treatment and/or a surface treatment for the wellbore fluid by performing an artificial intelligence technique and/or a closed form solution upon determination that the measured value is not within the assigned specification of the fluid property; and executing corrective product addition treatment or surface treatment based on performing the artificial intelligence technique and the closed form solution.

With respect to operation of one or more processors, determining the product addition treatment or surface treatment for the wellbore fluid can include determining whether the fluid property with the product addition treatment and/or surface treatment meets an operational criterion in addition to the assigned specification of the wellbore fluid. The operations can include determining a new product addition treatment and/or a new surface treatment for the wellbore fluid by performing a second artificial intelligence technique and/or a second closed form solution upon determination that the current product addition treatment and/or the current surface treatment is not executable in time to meet expected upcoming formation issues ahead of an operating drill bit.

Further, a machine-readable storage device, herein, is a physical device that stores data represented by physical structure within the device. Examples of machine-readable storage devices can include, but are not limited to, read only memory (ROM), random access memory (RAM), a magnetic disk storage device, an optical storage device, a flash memory, and other electronic, magnetic, and/or optical memory devices, or combinations thereof.

In various embodiments, a system can comprise one or more processors; a memory module operable with the one or more processors, wherein the one or more processors and the memory module are structured to operate to: measure a fluid property of a wellbore fluid by use of a measurement tool to provide a measured value of the fluid property; determine whether the measured value is within an assigned specification of the fluid property; determine a product addition treatment and/or a surface treatment for the wellbore fluid by performance of an artificial intelligence technique and/or a closed form solution upon determination that the measured value is not within the assigned specification of the fluid property; and execute corrective product addition treatment or surface treatment based the performance of the artificial intelligence technique and the closed form solution. The system can be structured to execute the one or more of the features of method 100, methods similar to method 100, other techniques taught herein, or combinations thereof.

The one or more processors and the memory module can be structured to operate to determine a new product addition treatment and/or a new surface treatment for the wellbore fluid by performance of a second artificial intelligence technique and a second closed form solution upon a determination that the current product addition treatment and/or the current surface treatment is not executable in time to meet expected upcoming formation issues ahead of an operating drill bit. The system can include a database to store data for the executed corrective product addition treatment or surface treatment as a function of a drilling parameter. The database may be constructed as part of the memory module or a separate structure.

In various embodiments, processes can be provided to test and model the impact of various fluid additives on drilling fluid properties at a rig site. These properties may include properties such as rheology, density, LCM effacicy, fluid lost, emulsion stability, etc. Using the pre-tested/real time results and the modeled impact of additives on fluid properties may permit better drilling management in regards to ECD, torque and drag, lost circulation, ROP, etc. These methods provide a useful tool for drilling optimization and the critical information required for dosing and automation.

Testing and modeling the impact of various fluid additives on drilling fluid properties at a rig site dovetails very well with an automatic mud measuring equipment (AMME) system. The AMME system can extract a fluid from an active mud pit, condition it, and then test the critical fluid properties. In various embodiments, an operational/test system can include the AMME system coupled to a another system or sub-system to add known concentrations of additives to the fluid extracted from the active mud pit. The operational/test system can be arranged such that, between real time active system measurements, the operational/test system can test pilot samples and create a database of various additive performance using the sub-system. As the demands of the drilling conditions change, the operational/test system can be a dosing automation system, which can have actual pilot test data to manage and determine the best opportunities for product additions to the mud pit.

Such an operational/test system can have a number of applications. The operational/test system may be used to model the performance of a rheological thinner that is used to reduce rheology in oil-based drilling fluids that have been treated with organophillic compounds such as viscosifiers or filtration control agents. Such thinners may be selected that can effectively reduce the plastic viscosity, yield point and gel strengths in these oil-based drilling fluids. The operational/test system can be operated such that sequential additions of a thinning material may be added to a known volume of drilling fluid. After sufficient mixing or other treatments, such as heating and/or pressurizing or other treatments, the drilling fluid properties may be measured. Thus, the thinning performance of a specific product to the fluid at the rig site can be determined with the thinning performance becoming a known quantity that can be used in active operation. Thus, real time additive/dosing systems can be managed.

Other applications can include modeling the performance of a LCM in regards to density, rheology, and suitability as a plugging material. Applications can include modeling the performance of weighting materials in regards to increased density and rheology. Using systems and methods, as taught herein, may provide for any type of fluid additive and the resultant performance metric to provide value in operational management at a rig site. Fluid additives may include, but not limited to, viscosifiers, thinners, lost circulation control additives, weighting materials, emulsifiers. Some additives may react with the drilling fluids such as clays, materials that can hydrate, materials that can expand, materials that can absorb components of the drilling fluids, and other types of materials.

An AMME system can be implemented to measure the properties of drilling fluids from an active pit. These properties can include density, rheology, emulsion stability (ES), oil to water ratio (OWR), ASG (average specific gravity of fluid solids), water phase salinity, and gel strength, which are fundamental measures to manage fluids in real time. In various embodiments, additional components can be coupled to the AMME system to dose various fluid additives to the drilling fluids. Once the fluid is mixed and conditioned, the fluid sample can be sent to the AMME system for testing. Test data can be stored in a database to be consumed by the control system. In the control system ANN, AI, or other methods can be used to model the fluid properties with any combinations and concentration of additive components. Once these performance models are built, drilling performance may be optimized relative to ROP, fluid rock interaction, lost circulation mitigation etc. In automatic or role based control by mud engineers etc., the control system may engage a dosing system to add various components at the desired levels.

Figure 3:
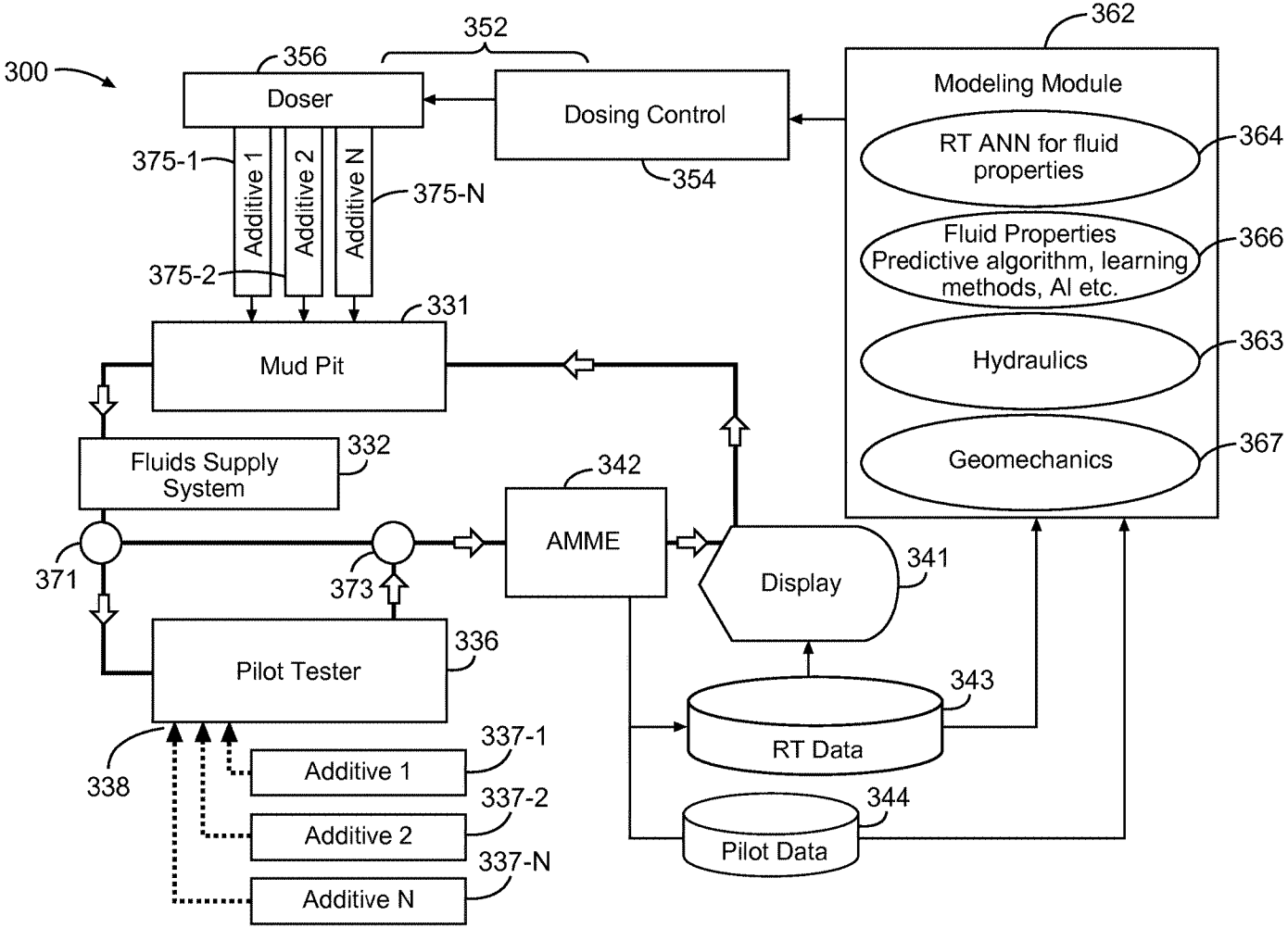
FIG. 3 is a block diagram of an example system to measure and model fluid additive performance parameters in real time, in accordance with various embodiments.

FIG. 3 is a block diagram of an embodiment of an example system 300 to measure and model fluid additive performance parameters in real time. The system 300 may be implemented to provide rig automation and drilling optimization. The system 300 can comprise a fluids supply system 332, AMME 342 operatively coupled to the fluids supply system 332, a dosing system 352, a modeling module 362, and a pilot tester 336. The fluids supply system 332 can be structured to extract fluid from a mud pit 331 at a drilling rig site. The dosing system 352 can be structured to inject one or more additives 357-1, 357-2, . . . 357-N into the mud pit 331. The modeling module 362 can be arranged to generate input to the dosing system 352 based on data from the AMME 342. The pilot tester 373 can be operatively coupled to the fluids supply system 332 and operatively coupled to the AMME 342, where the pilot tester 336 has an input 338 to receive one or more additives 337-1, 337-2, . . . 337-N. The input 338 may arranged as multiple individual inputs or as a single input.

System 300 can include flow controls 371 and 373 to selectively direct fluid to the AMME 342 from the fluids supply system 332 or from the pilot tester. During normal operation, fluid is directed to flow to the AMME 342 from the fluids supply system 332. During pilot testing, fluid is directed to flow to the pilot tester 336, which injects one or more additives 337-1, 337-2, . . . 337-N, and then the modified fluid is directed to the AMME 342 for testing. Alternatively, the pilot tester 336 can add one or more of additives 337-1, 337-2, . . . 337-N to fluid flowing from the fluids supply system 332 to the AMME 342 by appropriately controlling flow controls 371 and 373.

Conditioned fluids can be sent from the AMME 342 to the mud pit 331. Output signals can be sent from the AMME 342 to a display 341 that can provide a real time visualization of data from the AMME 342. Data can be transmitted from the AMME 342 to a database 343 to store real time data related to operational data and data can be transmitted from the AMME 342 to a database 344 to store pilot data from pilot testing. The database 343 and the database 344 may be structured as separate databases, as an integrated database appropriately organized to reflect and manage real time operational data and pilot data, or combinations thereof.

Operational data and pilot data can be transmitted from databases 343 and 344 to a modeling module 362. The operational data and/or the pilot data can be used with a number of models contain within the modeling module 362. The modeling module 362 may include one or more of a geomechanics model 367, a hydraulics model 363, a set of fluid properties predictive algorithms, learning methods, AI, etc. 366, and a real time ANN for fluid properties 364. Modeling module 362 may include one or more closed form solution models that may be used with one or more AI techniques as taught herein. The modeling module 362 can include an ANN, an adaptive model, or an AI model to generate the input to the dosing system 352 in real time using data from the AMME 342. The modeling module 362 can include the hydraulics model 363 and the geomechanics model 367 to determine operating parameters and fluid composition for a drilling scenario.

Output from the modeling module can be transmitted to the dosing system 352. The dosing system 352 may include a dosing control 354 and a doser 356 that injects the one or more additives 357-1, 357-2, . . . 357-N into the mud pit 331. The dosing control 354 and the doser 356 may be individual modules or may be an integrated instrument. The modeling module 362 may be an individual instrument or may be integrated with the dosing system 352, integrated with the databases 343, 344, or integrated with combinations of the dosing system 352, integrated the databases 343, 344. Depending on the degree of integrations between the above-mentioned components of the system 300, one or processors may be associated with each of the respective components of system 300 to direct various functions of these components. The system 300 can be used to control the fluids in the mud pit 331 and may be used to manage the drilling operation.

The system of FIG. 3 provides a pilot testing system with an AMME system. Such a system can provide a number of process functions. A sample of mud can be received from a fluid supply system with a known volume and initial properties. Additive materials can be added in known concentrations, where the new fluid can then be mixed and conditioned. The mixing and conditioning can be conducted with respect to shear and temperature. After mixing and conditioning, the fluid can be sent to the AMME system for testing fluid properties. AMME can perform the testing to create data for modeling. Operation of the AMME system can be conducted with communication with a control system or under the direction of the control system. New samples can be continuously created to maintain real time fluid properties models.

Automating pilot testing provides an opportunity to know exactly how an active and ever changing fluid system will behave with various additives and combinations of additives. As ECD windows get smaller and ever more difficult drilling conditions occur, knowing actual fluid and product performance metrics can enhance proactive management of drilling optimization and wellbore pressure management using applied fluids optimization (AFO) services.

Providing a pilot testing workflow may provide an essential element to automate fluids management at a rig site. Information from pilot test on the actual system fluids in use can remove or reduce uncertainty in static models or any adaptive techniques that are employed to build an automated fluids management system. Artificial neural net, adaptive, or AI models can be built in real time using the pilot test data.

In terms of modeling ECD, data from the pilot system may be coupled with hydraulic models such as DFG (drilling fluids graphics) to determine the best operating parameters and fluid composition for any drilling scenario. From a cross product service line (PSL) perspective, integration of a pilot test system with an AMME system may operationally provide the best possible fluid in use at the most optimum time.

Integration of a pilot test system with an AMME system, as taught herein, may generate characterized fluid performance with various additive concentrations at the rig site and in real time. Integration of a pilot test system with an AMME system may provide fluid/additive data to enable automated dosing systems. Integration of a pilot test system with an AMME system may extend the value proposition of automated fluid testing equipment such as AMME. Integration of a pilot test system with an AMME system may minimize non-productive time (NPT) at the rig site. Integration of a pilot test system with an AMME system can be arranged to model what-if drilling and hydraulic scenarios in real time using fluid treatment/composition as variables. Integration of a pilot test system with an AMME system can provide a fluid based drilling optimization.

Figure 4:
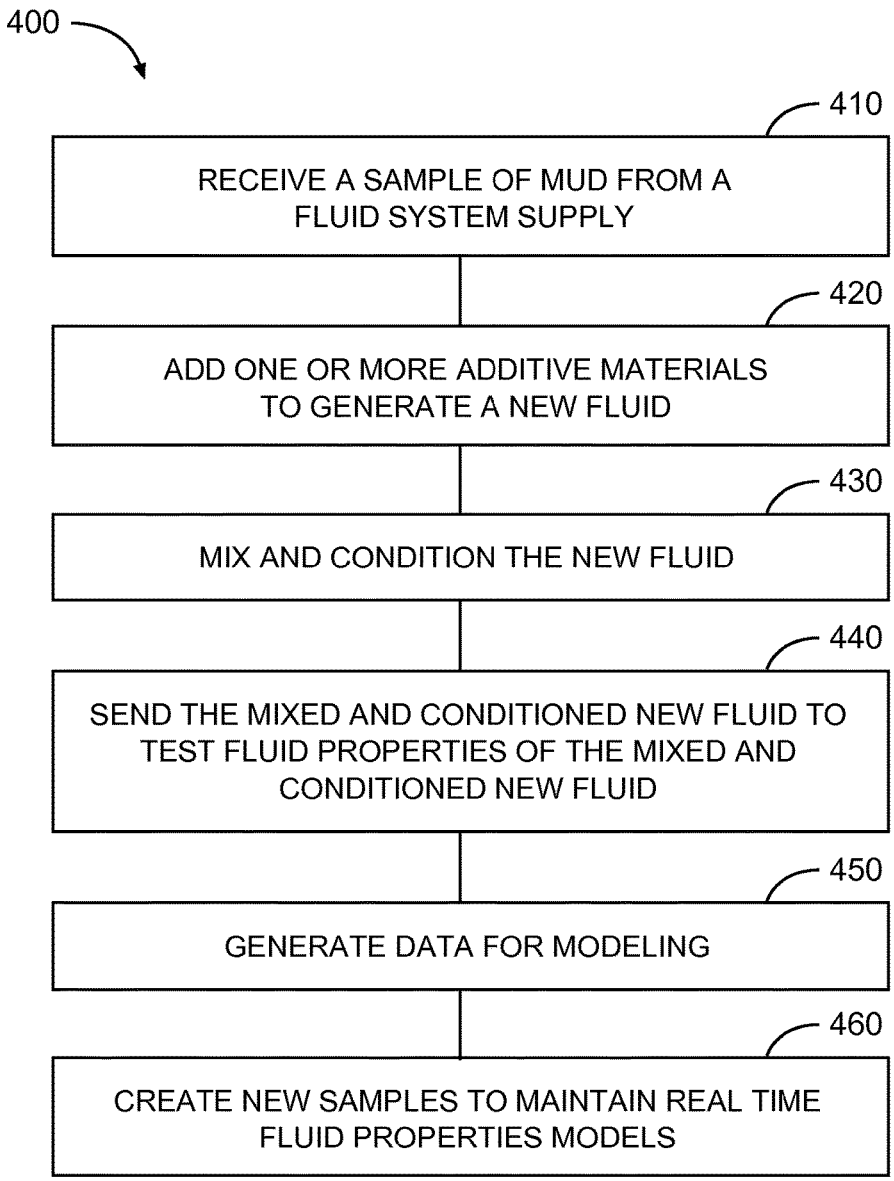
FIG. 4 is a flow diagram of an example method to measure and model fluid additive performance parameters in real time, in accordance with various embodiments.

FIG. 4 is a flow diagram of an embodiment of an example method 400 to measure and model fluid additive performance parameters in real time. Method 400 may be useful in rig automation and drilling optimization. At 410, a sample of mud from a fluid supply system is received. The sample may be received with a known volume and initial properties. At 420, one or more additive materials are added to generate a new fluid. The one or more additive materials may be added in known concentrations to the sample. The new fluid may be a modified version of the sample fluid. At 430, the new fluid is mixed and conditioned. Mixing and conditioning the new fluid can include mixing and conditioning the new fluid with respect to shear, temperature, and pressure. At 440, the mixed and conditioned new fluid is sent to test fluid properties of the mixed and conditioned new fluid. The testing can be conducted by an AMME. At 450, data is generated for modeling. At 460, new samples are created to maintain real time fluid properties models. Generating data for modeling and creating new samples to maintain real time fluid properties models can include updating a database with data of performance of a plurality of additives.

In methods identical or similar to method 400, generating data for modeling can include generating pilot test data. In such methods, the methods can include building artificial neural net, adaptive, or artificial intelligence models in real time using the pilot test data and controlling a doser to add one or more selected additives to a mud pit from which the sample is acquired by the fluid supply system. In methods identical or similar to method 400, such methods can include using a pilot tester to add the one or more additive materials in known concentrations to the sample to generate the new fluid, mix and condition the new fluid, and send the mixed and conditioned new fluid to the automatic mud measuring equipment during a period when the automatic mud measuring equipment is in a non-operational mode with respect to testing mud at a drilling site.

In various embodiments, a non-transitory machine-readable storage device can comprise instructions stored thereon, which, when performed by a machine, cause the machine to perform operations, the operations comprising one or more features similar to or identical to features of methods and techniques described with respect to method 400. The physical structures of such instructions may be operated on by one or more processors.

Figure 5:
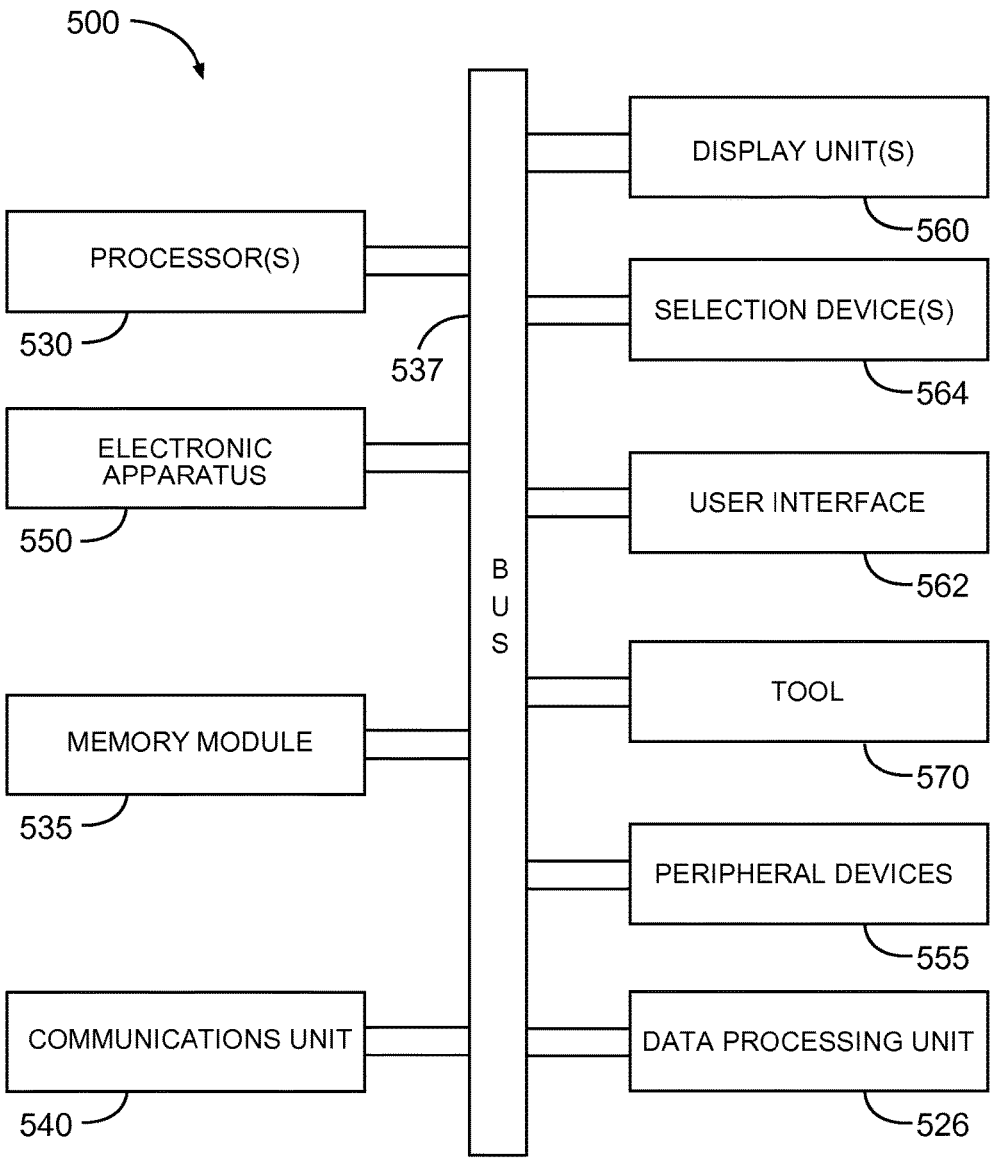
FIG. 5 is a block diagram of features of an example system operable to execute corrective action to a wellbore fluid at a drilling site and to measure and model fluid additive performance parameters in real time, in accordance with various embodiments.

FIG. 5 is a block diagram of features of an example system operable to execute corrective action to a wellbore fluid at a drilling site and to measure and model fluid additive performance parameters in real time. The system 500 can include a tool 570 to measure fluid properties. The system 500 can also include a one or more processors 530, a memory module 535, electronic apparatus 550, and a communications unit 540.

The one or more processors 530 and the memory module 535 can be arranged to operate the tool 570 to acquire measurement data as the tool 570 is operated. The one or more processors 530 and the memory module 535 can be realized to control activation of selected components of tool 570 and data acquisition from selected components of the tool 570 and to manage processing schemes with respect to data derivable from measurements using tool 570 as described herein. A data processing unit 526 can be structured to perform the operations to manage processing schemes in a manner similar to or identical to embodiments described herein. The data processing unit 526 may include a dedicated processor. The electronic apparatus 550 can be used in conjunction with the one or more processors 530 to perform tasks associated with taking measurements with the tool 570.

The system 500 can also include a bus 537, where the bus 537 provides electrical conductivity among the components of the system 500. The bus 537 can include an address bus, a data bus, and a control bus, each independently configured. The bus 537 can also use common conductive lines for providing one or more of address, data, or control, the use of which can be regulated by the one or more processors 530. The bus 537 can be configured such that the components of the system 500 can be distributed. The bus 537 may be arranged as part of a communication network allowing communication with control sites situated remotely from system 500.

In various embodiments, peripheral devices 555 can include displays, additional storage memory, and/or other control devices that may operate in conjunction with the one or more processors 530 and/or the memory module 535. The peripheral devices 555 can be arranged to operate in conjunction with display unit(s) 560 with instructions stored in the memory module 535 to implement a user interface 562 to manage the operation of the tool 570 and/or components distributed within the system 500. Such a user interface can be operated in conjunction with the communications unit 540 and the bus 537. Various components of the system 500 can be integrated such that processing identical to or similar to the processing schemes discussed with respect to various embodiments herein can be performed.

Figure 6:
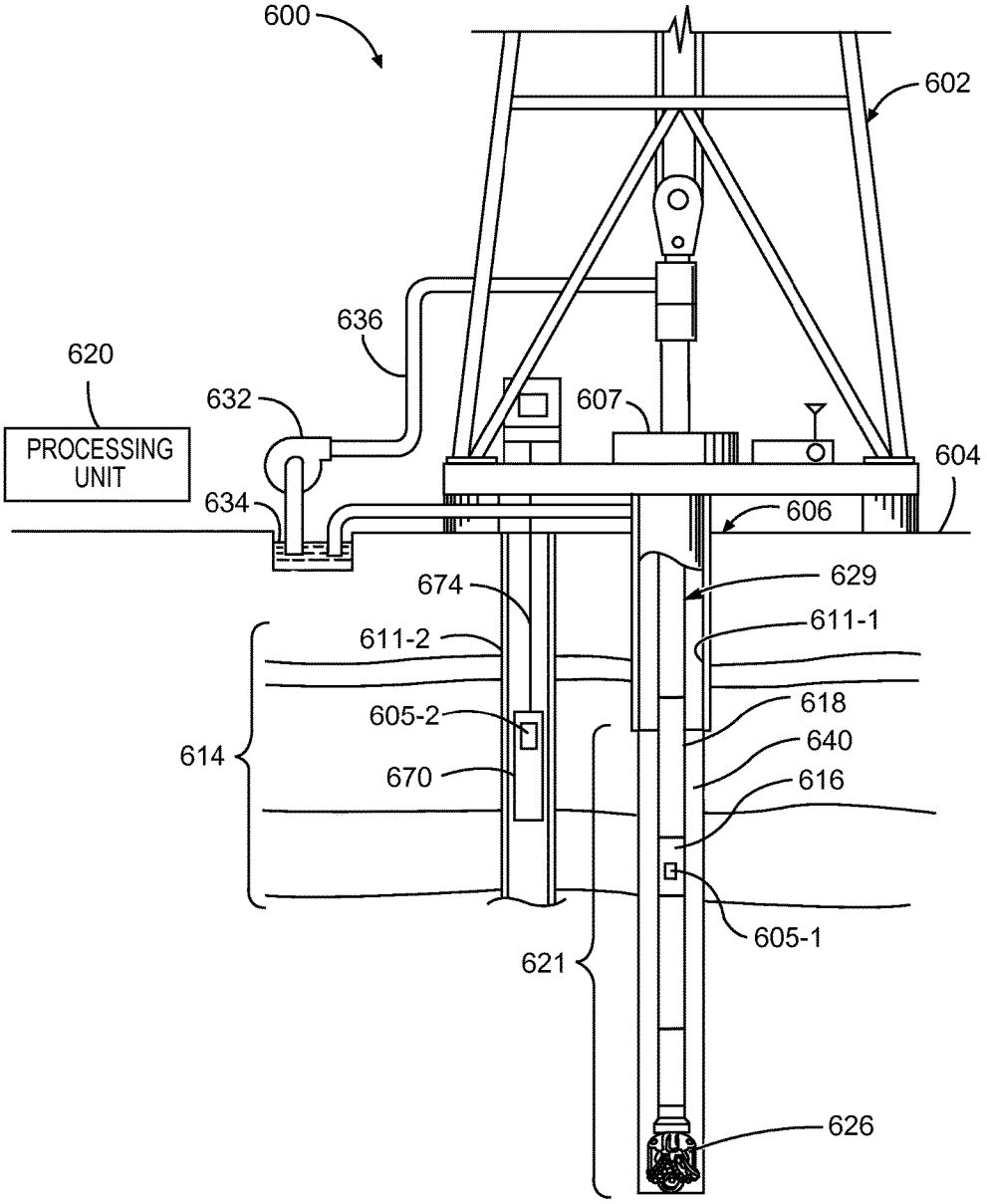
FIG. 6 is a schematic diagram of an example system at a drilling site, where the system includes components operable to execute corrective action to a wellbore fluid at the drilling site and to measure and model fluid additive performance parameters in real time, in accordance with various embodiments.

FIG. 6 is a schematic diagram of an embodiment of an example system 600 at a drilling site, where the system 600 includes components operable to execute corrective action to a wellbore fluid at the drilling site and to measure and model fluid additive performance parameters in real time. The system 600 can include a tool 605-1, 605-2, or both 605-1 and 605-2 operable to make measurements that can be used for a number of drilling tasks.

The system 600 can include a drilling rig 602 located at a surface 604 of a well 606 and a string of drill pipes, that is, drill string 629, connected together so as to form a drilling string that is lowered through a rotary table 607 into a wellbore or borehole 611-1. The drilling rig 602 can provide support for the drill string 629. The drill string 629 can operate to penetrate rotary table 607 for drilling the borehole 611-1 through subsurface formations 614. The drill string 629 can include a drill pipe 618 and a bottom hole assembly 621 located at the lower portion of the drill pipe 618.

The bottom hole assembly 621 can include a drill collar 616 and a drill bit 626. The drill bit 626 can operate to create the borehole 611-1 by penetrating the surface 604 and the subsurface formations 614. The bottom hole assembly 621 can include the tool 605-1 attached to the drill collar 616 to conduct measurements to determine formation parameters. The tool 605-1 can be structured for an implementation as a MWD system such as a LWD system. Measurements signals can be analyzed at a processing unit 620 at the surface 604 to provide analysis of data to measure and model fluid additive performance parameters in real time and to execute corrective action to a wellbore fluid at a drilling site as taught herein.

During drilling operations, the drill string 629 can be rotated by the rotary table 607. In addition to, or alternatively, the bottom hole assembly 621 can also be rotated by a motor (e.g., a mud motor) that is located downhole. The drill collars 616 can be used to add weight to the drill bit 626. The drill collars 616 also can stiffen the bottom hole assembly 621 to allow the bottom hole assembly 621 to transfer the added weight to the drill bit 626, and in turn, assist the drill bit 626 in penetrating the surface 604 and the subsurface formations 614.

During drilling operations, a mud pump 632 can pump drilling fluid (sometimes known by those of skill in the art as "drilling mud") from a mud pit 634 through a hose 636 into the drill pipe 618 and down to the drill bit 626. The drilling fluid can flow out from the drill bit 626 and be returned to the surface 604 through an annular area 640 between the drill pipe 618 and the sides of the borehole 611-1. The drilling fluid may then be returned to the mud pit 634, where such fluid is filtered. In some embodiments, the drilling fluid can be used to cool the drill bit 626, as well as to provide lubrication for the drill bit 626 during drilling operations. Additionally, the drilling fluid may be used to remove subsurface formation cuttings created by operating the drill bit 626. The processing unit 620 can be structured to operate on the drilling fluid in accordance with one or more processes and apparatus associated with features of FIGS. 1-5.

In various embodiments, the tool 605-2 may be included in a tool body 670 coupled to a logging cable 674 such as, for example, for wireline applications. The tool 605-2 can include measurements that can be analyzed with respect to drilling fluid and/or provide measurements of properties of the drilling fluid. The logging cable 674 may be realized as a wireline (multiple power and communication lines), a mono-cable (a single conductor), and/or a slick-line (no conductors for power or communications), or other appropriate structure for use in the borehole 611-2. Though FIG. 6 depicts both an arrangement for wireline applications and an arrangement for LWD applications, the system 600 may be structured to provide one of the two applications.

A method 1 can comprise: measuring a fluid property of a wellbore fluid such that a measured value of the fluid property is provided; determining whether the measured value is within an assigned specification of the fluid property; determining a product addition treatment and/or a surface treatment for the wellbore fluid by performing an artificial intelligence technique and/or a closed form solution upon determination that the measured value is not within the assigned specification of the fluid property; and executing corrective product addition treatment or surface treatment based on performing the artificial intelligence technique and/or the closed form solution.

A method 2 can include the elements of method 1 and can include determining the product addition treatment or surface treatment for the wellbore fluid to include determining whether the fluid property with the product addition treatment and/or surface treatment meets an operational criterion in addition to the assigned specification of the wellbore fluid.

A method 3 can include the elements of method 2 and can include the operational criterion to include one or more of a hydraulics constraint, torque and drag, filtration control, or lost circulation material concentration targets.

A method 4 can include the elements of any of methods 1-3 and can include executing corrective product addition treatment or surface treatment based on performing the artificial intelligence technique and/or the closed form solution conducted in time to meet expected upcoming formation issues ahead of an operating drill bit or determining a new product addition treatment and/or a new surface treatment for the wellbore fluid by performing a second artificial intelligence technique and/or a second closed form solution upon determination that the current product addition treatment and/or the current surface treatment is not executable in time to meet expected upcoming formation issues ahead of an operating drill bit.

A method 5 can include the elements of any of methods 1-4 and can include updating a database with data for the executed corrective product addition treatment or surface treatment as a function of a drilling parameter.

A machine-readable storage device 1 having instructions stored thereon, which, when executed by one or more processors of a machine, cause the machine to perform operations, the operations comprising: measuring a fluid property of a wellbore fluid such that a measured value of the fluid property is provided; determining whether the measured value is within an assigned specification of the fluid property; determining a product addition treatment and/or a surface treatment for the wellbore fluid by performing an artificial intelligence technique and/or a closed form solution upon determination that the measured value is not within the assigned specification of the fluid property; and executing corrective product addition treatment or surface treatment based on performing the artificial intelligence technique and/or the closed form solution.

A machine-readable storage device 2 can include determining the product addition treatment or surface treatment for the wellbore fluid to include determining whether the fluid property with the product addition treatment and/or surface treatment meets an operational criterion in addition to the assigned specification of the wellbore fluid.

A machine-readable storage device 3 can include the structure of machine-readable storage device 1 or 2 and can include the operations to include executing corrective product addition treatment or surface treatment based on performing the artificial intelligence technique and/or the closed form solution conducted in time to meet expected upcoming formation issues ahead of an operating drill bit, or determining a new product addition treatment and/or a new surface treatment for the wellbore fluid by performing a second artificial intelligence technique and a second closed form solution upon determination that the current product addition treatment and/or the current surface treatment is not executable in time to meet expected upcoming formation issues ahead of an operating drill bit.

A system 1 can comprise: one or more processors; a memory module operable with the one or more processors, wherein the one or more processors and the memory module are structured to operate to: measure a fluid property of a wellbore fluid by use of a measurement tool to provide a measured value of the fluid property; determine whether the measured value is within an assigned specification of the fluid property; determine a product addition treatment and/or a surface treatment for the wellbore fluid by performance of an artificial intelligence technique and/or a closed form solution upon determination that the measured value is not within the assigned specification of the fluid property; and execute corrective product addition treatment or surface treatment based the performance of the artificial intelligence technique and/or the closed form solution.

A system 2 can include the structure of system 1 and can include the one or more processors and the memory module structured to operate to determine a new product addition treatment and/or a new surface treatment for the wellbore fluid by performance of a second artificial intelligence technique and/or a second closed form solution upon a determination that the current product addition treatment and/or the current surface treatment is not executable in time to meet expected upcoming formation issues ahead of an operating drill bit.

A system 3 can include the structure of any of systems 1-2 and can include the system to include a database to store data for the executed corrective product addition treatment or surface treatment as a function of a drilling parameter A system 4 can comprise: a fluids supply system to extract fluid from a mud pit at a drilling rig site; an automatic mud measuring equipment operatively coupled to the fluids supply system; a dosing system to inject one or more additives into the mud pit; a modeling module to generate input to the dosing system based on data from the automatic mud measuring equipment; and a pilot tester operatively coupled to the fluids supply system and operatively coupled to the automatic mud measuring equipment, the pilot tester having an input to receive the one or more additives.

A system 5 can include the structure of system 4 and can include the modeling module to include an artificial neural net, an adaptive model, closed form, or an artificial intelligence model to generate the input to the dosing system in real time using data from the automatic mud measuring equipment.

A system 6 can include the structure of any of systems 4 or 5 and can include a hydraulics model and a geomechanics model to determine operating parameters and fluid composition for a drilling scenario.

A method 6 can comprise: receiving a sample of mud from a fluid supply system with a known volume and initial properties; adding one or more additive materials in known concentrations to the sample to generate a new fluid; mixing and conditioning the new fluid; sending the mixed and conditioned new fluid to an automatic mud measuring equipment to test fluid properties of the mixed and conditioned new fluid; generating data for modeling; and creating new samples to maintain real time fluid properties models.

A method 7 can include the elements of method 6 and can include mixing and conditioning the new fluid to include mixing and conditioning the new fluid with respect to shear and temperature.

A method 8 can include the elements of any of methods 6 or 7 and can include generating data for modeling and creating new samples to maintain real time fluid properties models to include updating a database with data of performance of a plurality of additives.

A method 9 can include the elements of any of methods 6-8 and can include generating data for modeling to include generating pilot test data.

A method 10 can include the elements of methods 9 and can include building artificial neural net, adaptive, closed form, or artificial intelligence models in real time using the pilot test data and controlling a doser to add one or more selected additives to a mud pit from which the sample is acquired by the fluid supply system.

A method 11 can include the elements of any of methods 6-10 and can include using a pilot tester to add the one or more additive materials in known concentrations to the sample to generate the new fluid, mix and condition the new fluid, and send the mixed and conditioned new fluid to the automatic mud measuring equipment during a period when the automatic mud measuring equipment is in a non-operational mode with respect to testing mud at a drilling site.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A method comprising:

measuring a fluid property of a wellbore fluid such that a measured value of the fluid property is provided;

determining whether the measured value is within an assigned specification of the fluid property;

determining a product addition treatment or a surface treatment for the wellbore fluid by performing an artificial intelligence technique or a closed form solution upon determination that the measured value is not within the assigned specification of the fluid property, wherein the artificial intelligence technique and the closed form solution utilize a test data set;

updating the test data set with the measured value and a known composition value of the wellbore fluid, wherein updating the test data set adjusts the artificial intelligence technique or the closed form solution; and executing corrective product addition treatment or surface treatment based on performing the artificial intelligence technique or the closed form solution.

2. The method of claim 1, wherein determining the product addition treatment or surface treatment for the wellbore fluid includes determining whether the fluid property with the product addition treatment or surface treatment meets an operational criterion in addition to the assigned specification of the wellbore fluid.

3. The method of claim 2, wherein the operational criterion includes one or more of a hydraulics constraint, torque and drag, filtration control, or lost circulation material concentration targets.

4. The method of claim 1, wherein the method includes determining a new product addition treatment or a new surface treatment for the wellbore fluid by performing a second artificial intelligence technique or a second closed form solution upon determination that the current product addition treatment or the current surface treatment is not executable in time to meet expected upcoming formation issues ahead of an operating drill bit.

5. The method of claim 1, wherein the method includes updating a database with data for the executed corrective product addition treatment or surface treatment as a function of a drilling parameter.

6. A machine-readable storage device having instructions stored thereon, which, when executed by one or more processors of a machine, cause the machine to perform operations, the operations comprising:

measuring a fluid property of a wellbore fluid such that a measured value of the fluid property is provided;

determining whether the measured value is within an assigned specification of the fluid property;

determining a product addition treatment or a surface treatment for the wellbore fluid by performing an artificial intelligence technique or a closed form solution upon determination that the measured value is not within the assigned specification of the fluid property, wherein the artificial intelligence technique and the closed form solution utilize a test data set;

updating the test data set with the measured value and a known composition value of the wellbore fluid, wherein updating the test data set adjusts the artificial intelligence technique or the closed form solution; and executing corrective product addition treatment or surface treatment based on performing the artificial intelligence technique or the closed form solution.

7. The machine-readable storage device of claim 6, wherein determining the product addition treatment or surface treatment for the wellbore fluid includes determining whether the fluid property with the product addition treatment or surface treatment meets an operational criterion in addition to the assigned specification of the wellbore fluid.

8. The machine-readable storage device of claim 6, wherein executing corrective product addition treatment or surface treatment based on performing the artificial intelligence technique or the closed form solution is conducted in time to meet expected upcoming formation issues ahead of an operating drill bit.

9. The machine-readable storage device of claim 6, wherein the operations include determining a new product addition treatment or a new surface treatment for the wellbore fluid by performing a second artificial intelligence technique or a second closed form solution upon determination that the current product addition treatment or the current surface treatment is not executable in time to meet expected upcoming formation issues ahead of an operating drill bit.

10. A system comprising:

one or more processors;

a memory module operable with the one or more processors, wherein the one or more processors and the memory module are structured to operate to:

measure a fluid property of a wellbore fluid by use of a measurement tool to provide a measured value of the fluid property;

determine whether the measured value is within an assigned specification of the fluid property;

determine a product addition treatment or a surface treatment for the wellbore fluid by performance of an artificial intelligence technique or a closed form solution upon determination that the measured value is not within the assigned specification of the fluid property, wherein the artificial intelligence technique and the closed form solution utilize a test data set;

update the test data set with the measured value and a known composition value of the wellbore fluid, wherein updating the test data set adjusts the artificial intelligence technique or the closed form solution; and execute corrective product addition treatment or surface treatment based the performance of the artificial intelligence technique or the closed form solution.

11. The system of claim 10, wherein the one or more processors and the memory module are structured to operate to determine a new product addition treatment or a new surface treatment for the wellbore fluid by performance of a second artificial intelligence technique or a second closed form solution upon a determination that the current product addition treatment or the current surface treatment is not executable in time to meet expected upcoming formation issues ahead of an operating drill bit.

12. The system of claim 10, wherein the system includes a database to store data for the executed corrective product addition treatment or surface treatment as a function of a drilling parameter.

13. A system comprising:

a fluids supply system to extract fluid from a mud pit at a drilling rig site;

an automatic mud measuring equipment operatively coupled to the fluids supply system;

a dosing system to inject one or more additives into the mud pit;

a modeling module to generate input to the dosing system based on data from the automatic mud measuring equipment; and a pilot tester operatively coupled to the fluids supply system and operatively coupled to the automatic mud measuring equipment, the pilot tester having an input to receive the one or more additives.

14. The system of claim 13, wherein the modeling module includes an artificial neural net, an adaptive model, closed form, or an artificial intelligence model to generate the input to the dosing system in real time using data from the automatic mud measuring equipment.

15. The system of claim 14, wherein the modeling module includes a hydraulics model and a geomechanics model to determine operating parameters and fluid composition for a drilling scenario.

16. A method comprising:

receiving a sample of mud from a fluid supply system with a known volume and initial properties;

adding one or more additive materials in known concentrations to the sample to generate a new fluid;

mixing and conditioning the new fluid;

sending the mixed and conditioned new fluid to an automatic mud measuring equipment to test fluid properties of the mixed and conditioned new fluid;

generating data for modeling; and creating new samples to maintain real time fluid properties models.

17. The method of claim 16, wherein mixing and conditioning the new fluid includes mixing and conditioning the new fluid with respect to shear and temperature.

18. The method of claim 16, wherein generating data for modeling and creating new samples to maintain real time fluid properties models includes updating a database with data of performance of a plurality of additives.

19. The method of claim 16, wherein generating data for modeling includes generating pilot test data.

20. The method of claim 19, wherein the method includes building artificial neural net, adaptive, closed form, or artificial intelligence models in real time using the pilot test data and controlling a doser to add one or more selected additives to a mud pit from which the sample is acquired by the fluid supply system.

21. The method of claim 16, wherein the method includes using a pilot tester to add the one or more additive materials in known concentrations to the sample to generate the new fluid, mix and condition the new fluid, and send the mixed and conditioned new fluid to the automatic mud measuring equipment during a period when the automatic mud measuring equipment is in a non-operational mode with respect to testing mud at a drilling site.

* * * * *